United States Patent [19]

Martin

[11] 4,295,185

[45] Oct. 13, 1981

[54] FILAMENT MOUNT ASSEMBLY FOR MINIATURE INCANDESCENT LAMP, AND METHOD OF MANUFACTURE

[75] Inventor: Jack Martin, Paramus, N.J.

[73] Assignee: Westinghouse Electric Corp., Pittsburgh, Pa.

[21] Appl. No.: 79,150

[22] Filed: Sep. 26, 1979

[51] Int. Cl.[3] ..... F21M 3/30

[52] U.S. Cl. ..... 362/211; 313/315; 362/310

[58] Field of Search ..... 313/315; 362/211, 310

[56] References Cited

U.S. PATENT DOCUMENTS 2,214,472 9/1940 Lund ..... 362/211

*Primary Examiner*—Stephen J. Lechert, Jr.
*Attorney, Agent, or Firm*—D. S. Buleza

[57] ABSTRACT

Precise placement of one or more coiled filaments within the envelope of a miniature type incandescent lamp is achieved by positioning the coil legs in end-to-end abutting relationship with the respective lead wires and locking them in such junctured relationship with metal tubes that enclose and are fastened to the abutted end portions of the mated lead wires and coil legs and thus couple the members together. The coupling tubes are first secured to the lead wires so that their open ends provide tubular pockets which receive the coil legs and guide them into the proper mounting position on the lead wires. The open ends of the tubes are then hot-clamped around the associated coil legs, thereby mechanically and electrically joining the members together in operative relationship. The invention is particularly useful in the production of miniature halogen-cycle type incandescent lamps that are employed as compact light sources in sealed-beam automotive lamps which require one or more precisely-mounted filaments.

10 Claims, 15 Drawing Figures

FILAMENT MOUNT ASSEMBLY FOR MINIATURE INCANDESCENT LAMP, AND METHOD OF MANUFACTURE

BACKGROUND OF THE INVENTION

This invention generally relates to electric incandescent lamps and has particular reference to an improved filament mount assembly for such lamps, and to a novel method of manufacturing the mount assemblies.

One of the critical problems encountered in the production of incandescent lamps involves the mounting of the coiled filament within the envelope and its attachment to the lead-in conductors. In large type incandescent lamps, this is generally achieved by sealing a glass stem to a pair of lead wires and forming the ends of the leads into clamps that are closed around the ends of the filament coil. Various other means for attaching the filament to the lead wires have also been employed down through the years. For example, U.S. Pat. No. 1,046,785 to Henderson discloses a lamp in which ends of the filament are secured to the lead wires by forming the ends of the wires into short helices or tubes that are attached to the filament by fusing or pasting the members together. In accordance with U.S. Pat. No. 768,173 (Fanta) the ends of the lamp filament are fastened to tubular metal tips which in turn, are inserted into and secured to metal sleeves that are attached to the inner ends of the platinum lead wires. The use of several interfitted tubular members to fasten the lead wires of an incandescent lamp to a filament is also disclosed in U.S. Pat. No. 2,398,969 to Singer. A fluorine-containing incandescent lamp having lead wires with end portions that are drilled to provide tubular cavities which receive the ends of a tungsten filament and protect them from attack by the fluorine additive is disclosed in U.S. Pat. No. 3,263,113 to Schröder.

The filament mounting operation is even more complicated in the case of automotive sealed-beam type lamps where one or a pair of coiled filaments must not only be fastened to the lead wires but accurately positioned relative to one another and the focal point of the reflector in a very confined space in order to provide the proper high-beam and low-beam light patterns. A sealed-beam type incandescent lamp in which accurate placement of a pair of coiled filaments within the reflector component of the envelope is achieved by clamping a short auxiliary lead wire to each of the filament legs and then inserting such auxiliary leads into notched ends of the main lead-in wires and welding them in place is disclosed in U.S. Pat. No. 3,513,347 to Murray et al. The use of metal sleeve components to facilitate the attachment of the filament legs to the lead-in wires of an incandescent lamp is also generally known in the art and is disclosed in U.S. Pat. No. 3,854,180 to Pastijn et al. In accordance with the patented method, the filament leg is inserted into a cylindrical metal sleeve which is positioned in transverse relationship with the lead wire and the sleeve is then compressively deformed and simultaneously spot welded to both the lead wire and the filament leg.

SUMMARY OF THE INVENTION

The present invention not only eliminates the costly and time-consuming operations required by the complicated filament mount assemblies and filament-lead wire connections of the prior art but provides a mount that is stronger and more reliable. Such simplification and improved quality are achieved by utilizing hollow metal tubes to mechanically and electrically couple the lead wires to the coiled filament. The lead wires and uncoiled legs of the filament are disposed in end-to-end abutting relationship and the coupling tubes enclose and are fastened to the mated ends of the legs and wires in "bridging" relationship.

In accordance with a preferred embodiment, the lead wires are held in predetermined spaced relationship with one another by a bridge member composed of insulating material and the inner ends of the lead wires are bent and offset in such a manner that they provide automatic stop means for the coupling tubes when they are slipped over the ends of the lead wires. The tubes are then hot-clamped or otherwise secured to the lead wires and their protruding open ends thus serve as automatic guide and positioning means for the filament legs which permit the latter to be simply inserted into the respective tubes until the ends of the legs seat against the tips of the lead wires. The coupling tubes are then hot clamped or otherwise secured to the filament legs, thus completing the mounting operation and insuring that the coiled body portion of the filament will be located in the desired position within the lamp when the mount is sealed into the envelope.

The reliable electrical and mechanical connections and the accurate orientation of the filament provided by the invention are particularly advantageous in the miniature type halogen-cycle incandescent lamps now being used as the light sources in sealed-beam automotive lamp units insofar as they not only permit one or two filaments to be mounted within the confines of the small envelope but to be placed in the precise optical relationship with the focal point of the reflector required to produce the desired light beam pattern or patterns when the sealed-beam lamp unit is energized.

BRIEF DESCRIPTION OF THE DRAWINGS

A better understanding of the invention will be obtained from the exemplary embodiment shown in the accompanying drawings, wherein.

DESCRIPTION OF THE PREFERRED EMBODIMENT

Figure 1:
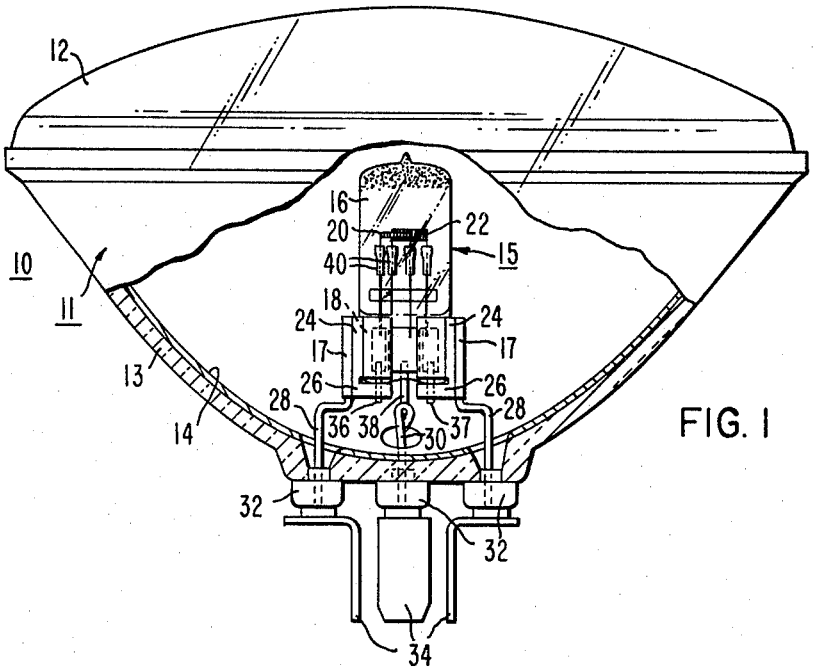
FIG. 1 is a side elevational view, partly in section, of a sealed-beam lamp unit and an inner miniature lamp component according to the present invention.

A sealed-beam lamp unit 10 which contains a halogen-cycle type miniature lamp component 15 and embodies the present invention is shown in FIG. 1. As will be noted, the sealed-beam lamp envelope 11 consists of the usual lens component 12 that is composed of glass (or other suitable light-transmitting material such as a heat-resistant plastic or the like) and is sealed along its periphery to a paraboidal-shaped reflector component 13 of the same material that has its inner surface coated with a layer 14 of aluminum or other highly-reflective metal that provides a mirror-like surface. The sealed-beam envelope 11 is evacuated through a tubulation (not shown) which is tipped off after the envelope has been filled with a suitable inert gas such as nitrogen or the like in the usual manner.

Figure 1A:
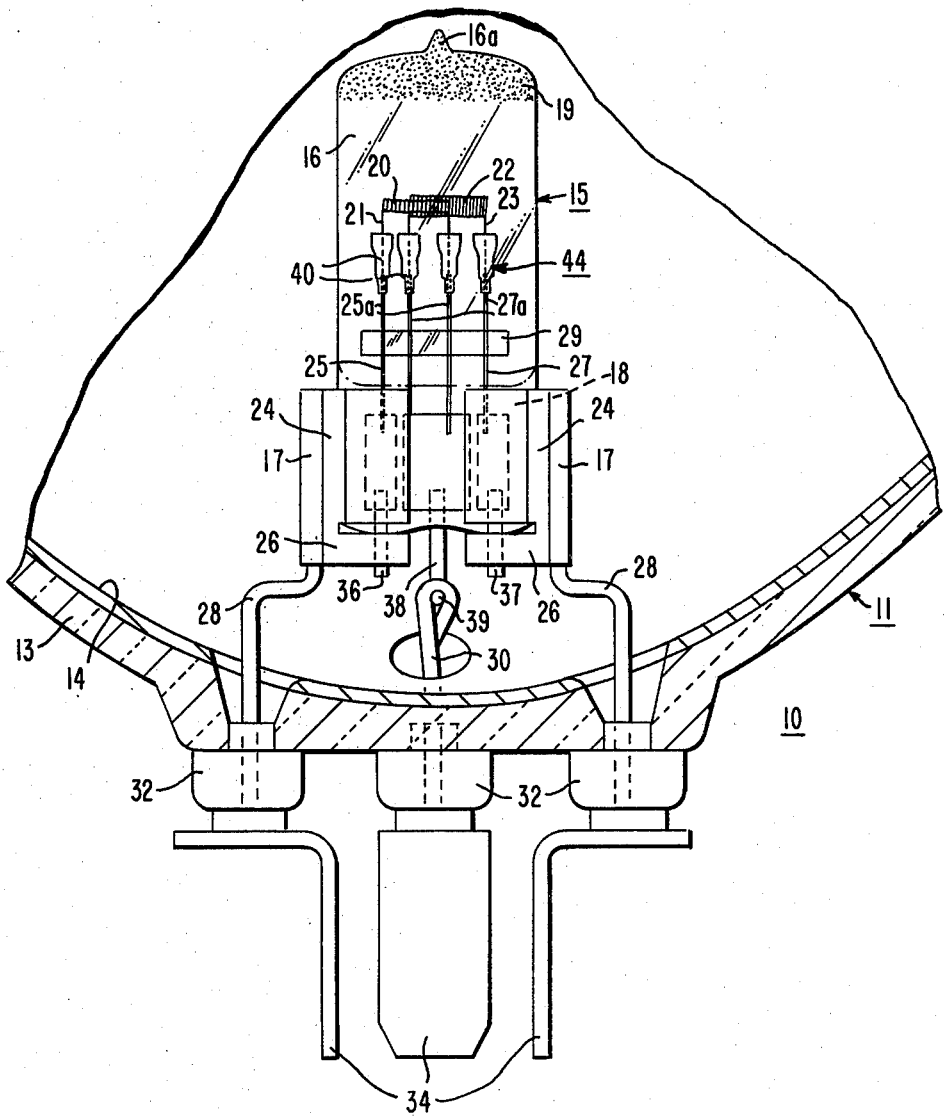
FIG. 1A is an enlarged view of the lamp mount and holder assembly employed in the sealed-beam lamp unit of FIG. 1.

As depicted more clearly in the enlarged fragmentary view of the sealed-beam lamp-mount assembly illustrated in FIG. 1A, the miniature inner lamp component 15 comprises a light-transmitting tubular envelope 16 that is terminated by a suitable hermetic seal such as press seal 18 and 16 contains a pair of coiled tungsten-wire filaments 20 and 22 that are disposed in aligned but laterally spaced relationship. The lamp 15 is positioned so that both of the filaments 20, 22 extend transversely across the optical axis of the sealed-beam lamp 10 in prefocused position relative to the focal point of the reflector component 13. The miniature lamp component 15 is held in such position within the sealed-beam lamp envelope 11 by suitable means such as a pair of sheet-metal clips 24 that are slipped over and frictionally engage the side edges of the press seal 18 and have end tabs 26 that are seated against the end of the press seal and welded to the protruding portions of the outer leads 36, 37 of the lamp 15. Each of the metal clips or holders 24 also have a longitudinal cylindrical-shaped portion 17 that is slip-fitted over and secured to the inner ends of the main lead wires 28 of the sealed-beam lamp unit 10. A third main lead wire 30 is clamped around or otherwise connected to the protruding end of the third outer lead wire 38 of the inner lamp component 15 that is common to both filaments 20, 22 and thus permits the filaments to be selectively energized separately or together in the usual fashion to provide the desired beam patterns. The main lead wires 28 and 30 extend through suitable openings in the reflector component 13 and are joined to metal ferrules 32 that are sealed to the back of the reflector component 13. The ferrules are provided with the usual metal-blade connectors 34 which permit the lamp unit 10 to be plugged into the lamp socket of the car or other vehicle.

The main leads 28, 30 are fabricated from heavy gauge wire and are thus rigid enough to hold the inner lamp component 15 and its clips 24 in proper position relative to the reflector component 13.

The inner lamp component 15 and filament mount 44 which embody the present invention are shown in greater detail in FIGS. 2–3 and FIGS. 4–6, respectively, and will now be described so that those skilled in the art can better recognize and appreciate the novel and advantageous features of the invention.

Figure 2:
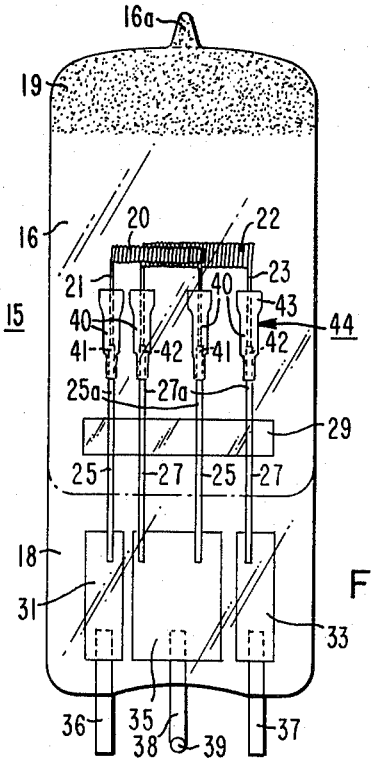
FIGS. 2 and 3 are enlarged front and side elevational views, respectively, of the dual-filament inner lamp component employed in the sealed-beam lamp unit of FIG. 1.
Figure 3:
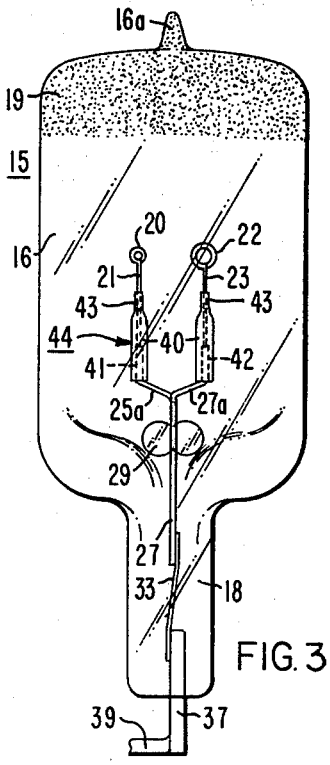

As will be noted in FIGS. 2 and 3, the domed end of the tubular envelope 16 is terminated by a protruding tip **16*a* which constitutes the remnant of the exhaust tubulation through which the lamp component 15 is evacuated and the filled with a suitable inert gas (such as argon or krypton at a pressure of approximately one atmosphere). If the lamp 15 is of the halogen-cycle type, such tubulation is also used to dose the envelope 16 with a suitable additive such as an iodide or bromide compound that thermally decomposes when the filaments 20, 22 are energized and releases a sufficient quantity of halogen to establish the well-known tungsten-halogen cycle within the envelope during operation. The chemical reactions are such that vaporized tungsten is returned back to the filaments, thus enhancing the light output and useful life of the lamp. The domed end of the envelope 16 is desirably coated with an opaque layer 19 of black paint or the like in order to block direct light rays which would otherwise pass through this portion of the envelope and produce objectionable glare light when the lamp component 15** is used as the light source in a sealed-beam lamp unit.

Each of the filaments 20, 21 are formed from tungsten wire of carefully selected size which is wound to provide a helically-coiled body portion of the desired wattage rating that is terminated at each end by an uncoiled leg segment which extends laterally from the body portion. As shown in FIGS. 2 and 3, the legs 21 of filament 20 are disposed in side-by-side spaced relationship and are substantially aligned with one another so that they lie in a common plane. The legs 23 of the larger filament coil 22 are similarly arranged in another plane.

Figure 5:
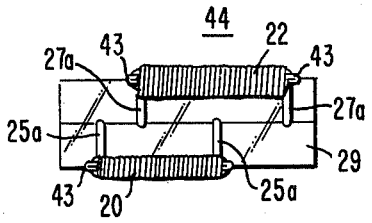
FIGS. 4 and 5 are front elevational and top plan views, respectively, of the filament-mount assembly employed in the lamp component shown in FIGS. 2 and 3.

In accordance with the invention, the coiled filaments 20, 22 are held in precise location within the lamp 15 and in offset relationship with one another by sleeve-like coupling means such as stiff metal tubes 40 that overlie and enclose the junctures formed by the ends of the respective filament legs and the associated end segments of the inner lead-in conductors, which conductors are anchored in an extend from the press seal 18. The lead-in conductors preferably comprise two pairs of rigid lead wires 25 and 27 that are of predetermined length and have transversely bent medial portions **25*a*, 27*a* which extend in opposite directions (as shown in FIGS. 3 and 5) so that the straight end segments 41, 42 of the paired wires are laterally offset from one another and aligned with the legs of the respective filaments. Lead wires 25 thus have their free end segments 41 disposed in aligned abutting engagement with legs 21 of coiled filament 20 and the other pair of lead wires 27 have their end segments 42 disposed in the same relationship with the legs 23 of the other coiled filament 22. The abutted tips or ends of the respective inner lead wires and coil legs are electrically and mechanically coupled together by the stiff metal tubes 40 that bridge and encapsulate the mated parts of the members, with each tube being hot clamped (or otherwise secured) to the enclosed members so as to compressively grip the respective lead wires and filament legs. Since the diameter of the filament legs is much smaller than that of the inner lead wires, the ends of the coupling tubes 40 which enclose the legs are inherently collapsed by the hot-clamping operation and form flats 43** that insure a positive and reliable connection with each of the associated filament legs.

As illustrated in FIGS. 2–5, the portions of the paired lead wires 25, 27 which are located between the press seal 18 and laterally-bent medial parts **25*a*, 27*a* of the wires are joined together by a suitable bridge member 29 of electrically non-conductive material such as a pair of quartz rods that are fused together in sandwiched relationship with the lead wires. This not only rigidifies the structure but holds the various parts together to provide an integral mount assembly 44 shown in FIGS. 4 and 5, which can be readily handled as a separate part and sealed into the envelope 16** in the usual manner.

As will be noted in FIG. 2, one end of the coiled filament 20 is electrically connected by the associated leg 21, lead wire 25 and coupling tube 40 to a ribbon conductor 31 that is embedded in the press seal 18 and is, in turn, connected to an outer lead wire 36 that is anchored in and extends beyond the press seal. In similar fashion, one end of the other filament 22 is connected by its associated leg 23, inner lead wire 27 and coupling tube 40 to another ribbon conductor 33 that is embedded in the press seal and connected to a second outer lead wire 37. The other ends of the filaments 20, 22 are connected by the associated legs 21 and 23, inner lead wires 25, 27 and coupling tubes 40 to a centrally located ribbon conductor 35 that is connected to a third outer lead wire 38 and thus serves as a common connection or contact for the lamp 15 which permits the filaments to be selectively energized in unison or separately. Outer lead wire 38 has a laterally-extending tip portion 39 so that it can be anchored in the clamped end of the main lead wire 30 of the sealed-beam lamp unit 10.

As shown in FIGS. 2 and 3, the seal-anchored ends of the inner lead wires 25, 27 are disposed in the same plane as the press seal 18 and such plane extends along the longitudinal axis of the envelope 16. In contrast, the offset medial portions 25*a*, 27*a* of the lead wires align the straight end segments 41 and 42 of the lead wires and the attached coupling tubes 40 with the filament legs 21 and 23 so that they lie in common planes that are spaced from one another and are also displaced from but parallel to the longitudinal axis of the envelope 16.

In the case of a miniature lamp 15 of the halogen-cycle type here illustrated and described, the envelope 16 and bridge member 29 are made of quartz and the inner leads 25, 27 and coupling sleeves 40 are fabricated from molybdenum. However, the envelope can also be made from a suitable "hard" glass, such as borosilicate glass, and the inner lead wires and coupling sleeves can also be made from tungsten or tantalum, or a similar metal that resists chemical attack from the particular halogen additive which is used. However, the invention is not limited to halogen-cycle type lamps and can be used with equal advantage in standard type miniature incandescent lamps that do not contain any halogen-producing additives and thus permit the inner leads and coupling members to be made from any suitable metal such as nickel, nickel-plated iron, etc.

As will be noted in FIG. 3, each of the coupling tubes 40 are seated against the transversely-extending medial bent portions 25*a*, 27*a* of the lead wires 25, 27. These medial bent portions thus serve as stop-and-positioning means for the respective coupling tubes 40 during the mount fabricating operation hereinafter described.

Figure 6:
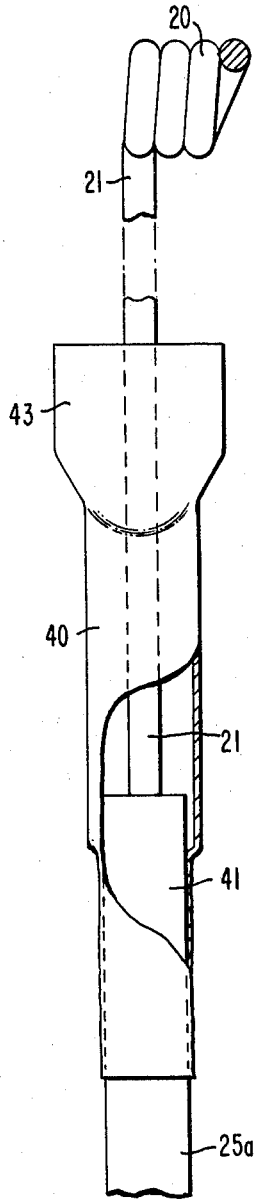
FIG. 6 is an enlarged fragmentary view of one of the filament-wire connections, a portion of the coupling tube being removed to show how it locks the tips of the filament leg and lead wire in abutting end-to-end relationship; and, FIGS. 7A to 7H are pictorial views of various stages in the manufacture of the dual-filament mount assembly shown in FIGS. 4 and 5 and employed in the miniature lamp component illustrated in FIGS. 2 and 3.

As shown in FIG. 6, each of the coupling tubes 40 are preferably of cylindrical configuration and totally encapsulate and firmly grip the mated parts of the filament legs 21, 23 and the lead wire ends 41, 42 to form a strong and very reliable electrical and mechanical juncture. As will be noted, the tubes 40 are of such size that they make a snug fit with the inner lead wires and are thus only slightly collapsed by the hot-clamping operation. Since each of the filament legs are of predetermined length and seated against the ends of the lead wires, which are also cut to a predetermined length, the coupling tubes 40 of the present invention not only provide the desired mechanical and electrical connection of the filaments 20, 22 with their lead wires 25, 27 but insure that the coiled body portions of the filaments are located in precise spatial relationship with respect to one another and to the focal point of the sealed-beam lamp envelope 11 in which the lamp component 15 is subsequently placed.

FILAMENT MOUNT MANUFACTURE (FIGS. 7A–7H)

The various steps in fabricating the filament mount assembly 44 in accordance with the invention are illustrated in FIGS. 7A to 7H and will now be described.

Figure 7A:
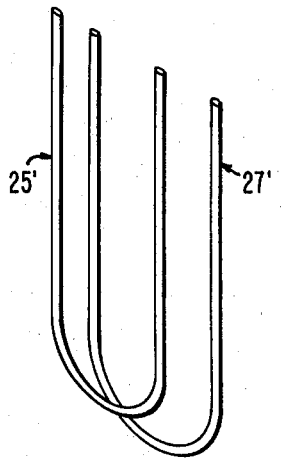

As shown in FIG. 7A, the first step in the operation is to provide a pair of U-shaped lead-wire members 25', 27' and position them as shown so that they are disposed in a common plane and slightly offset from one another. These members will ultimately comprise the inner lead wires 25, 27 of the mount assembly 44 and are thus made of suitable material and are of the proper size or diameter.

Figure 7B:
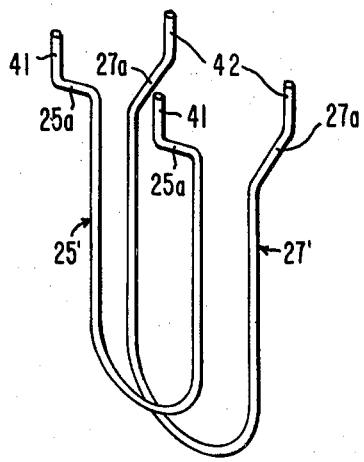

The next phase of the operation is shown in FIG. 7B and consists of bending the ends of the respective hairpin-shaped wire members 25', 27' in such a manner that the free end segments 41 and 42, respectively, of the members are substantially straight and offset from one another by medial bends 25*a*, 27*a* which position such end segments in parallel spaced planes and orient them in a manner which aligns them with the legs of the filament coil to which they will be eventually coupled.

Figure 7C:
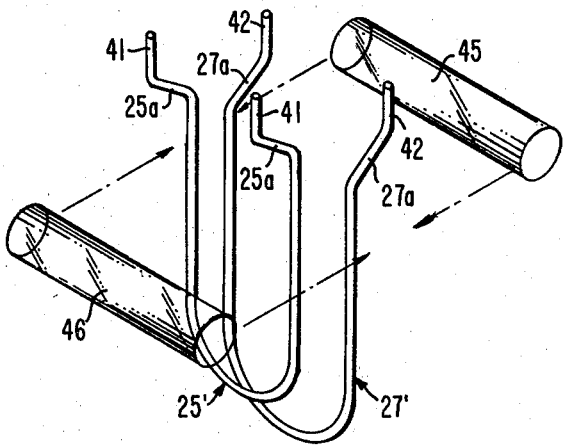

As illustrated in FIG. 7C, the next operation comprises the bridge-forming step and is accomplished by placing the hairpin-shaped lead wire members 25', 27' in a suitable fixture (not shown) and then heating two rod-like pieces 45, 46 of quartz cane to soft and tacky condition and forcing them against one another (from opposite sides of the wire members 25' and 27') so that the quartz pieces are fused and bonded together in sandwiched relationship with the wire members adjacent the medial bends 25*a*, 27*a*.

Figure 7D:
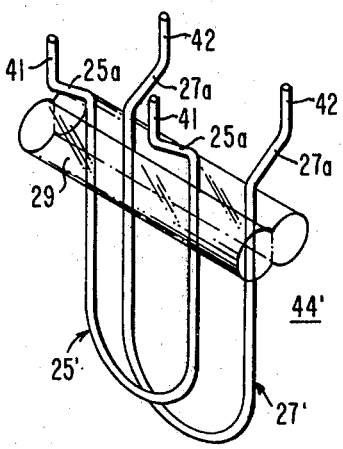

The resulting embryonic mount 44' is shown in FIG. 7D. Since the hairpin-shaped lead wire members 25' and 27' are now joined together by the quartz bridge member 29, the curved U-bend portions of each member are severed and discarded to form the desired separate pairs of inner lead wires 25 and 27.

Figure 7E:
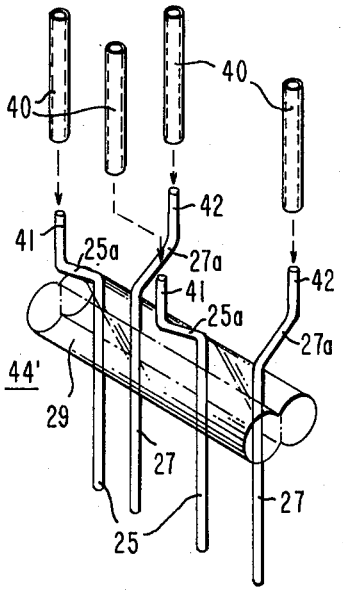
Figure 7F:
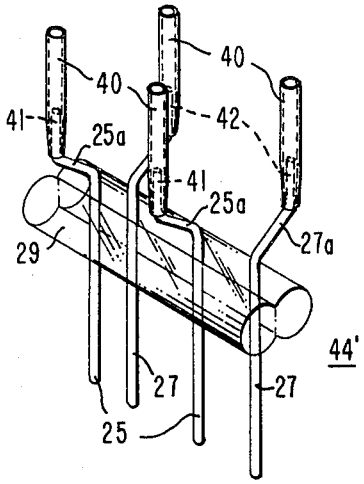
Figure 7G:
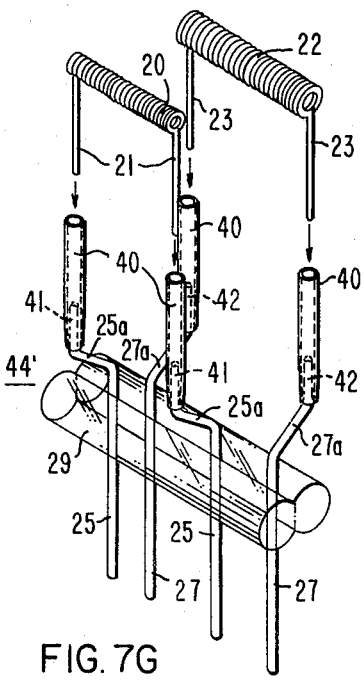
Figure 7H:
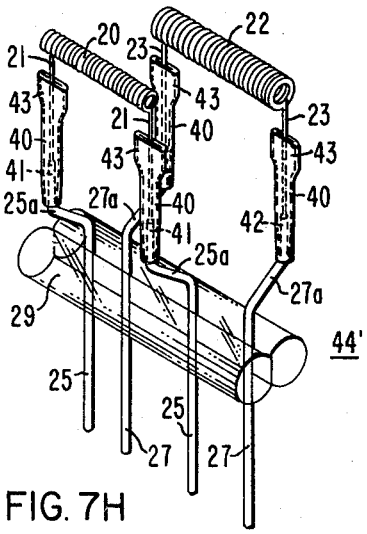

As shown in FIG. 7E, the metal coupling tubes 40 are then slipped over the straight end segments 41, 42 of the respective pairs of lead wires 25, 27 until they seat against the medial bends 25*a*, 27*a* formed in each wire. The coupling tubes 40 are then hot clamped (or otherwise fastened) to the enclosed ends 41, 42 of the lead wires to anchor them in such position and produce the assembly 44' illustrated in FIG. 7F. The next step is shown in FIG. 7G and consists of inserting the legs 21, 23 of the coiled filaments 20, 22 into the protruding open ends of the tubes 40 until the tips of the legs are firmly seated against the tips of the lead wire ends 41, 42. The open ends of the coupling tubes 40 are then hot clamped and collapsed (as shown in FIG. 7H) to form flats 43 which compressively grip the respective coil legs and securely lock the members together in positive electrical engagement.

Figure 4:
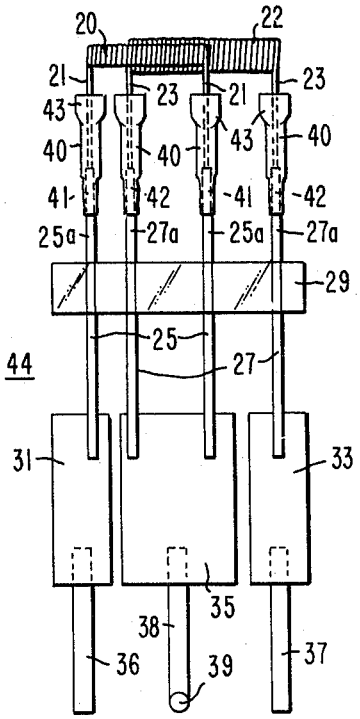

The free ends of the inner lead wires 25, 27 are then secured (as by welding) to the aforementioned ribbon conductors 31, 33, 35 and the outer lead wires 36, 37 and 38 are secured to the other ends of the ribbon conductors to form the finished mount assembly 44 shown in FIGS. 4 and 5. The mount assembly is then inserted into the open end of the envelope 16 and properly positioned therein by a centralizing pin or other means in the usual fashion so that the ribbon conductors are hermetically embedded in the press seal 18 which is subsequently formed by heating and compressing the end of the envelope.

While the sleeve-like coupling means in the illustrated embodiment consists of cylindrical metal tubes 40, channel-like members of U-shaped cross section and other conductive material can also be employed if desired and crimped or hot-clamped to the mated ends of the lead wires and coil legs that are to be joined. It will also be understood to those skilled in the art that such crimping or hot-clamping modes of fastening are not essential features of the invention and that welding, brazing, etc. can also be used. The invention is also not limited to dual-filament miniature lamps of the type illustrated but can be employed in lsmpas that contain a single filament and are of larger size.

I claim:

1. An electric incandescent lamp comprising;

a sealed light-transmitting envelope containing a refractory wire filament having a coiled body portion that is terminated at each end by an uncoiled leg, a pair of substantially rigid lead-in conductors extending into said envelope and having end segments that are disposed in abutting end-to-end relationship with the respective legs of the filament and form therewith a pair of filament-conductor junctures, and means electrically and mechanically coupling the filament legs to the associated abutting end segments of the lead-in conductors comprising a pair of sleeve-like members of stiff electrically-conductive material that are disposed in overlying bridging relationship with the respective filament-conductor junctures, said sleeve-like coupling members being fastened to the abutted parts of the filament legs and lead-in conductors in overlapped engagement therewith and thereby securely locking the filament and lead-in conductors in operative relationship.

2. The incandescent lamp of claim 1 wherein;

the uncoiled legs extend transversely from the coiled body portion of said filament and are substantially disposed in spaced side-by-side relationship, and said lead-in conductors are of predetermined length and thus position and hold the coiled body portion of the filament at a predetermined location within the envelope.

3. The incandescent lamp of claim 2 wherein;

the abutted portions of the filament legs and the end segments of the lead-in conductors are substantially straight and aligned with one another, medial portions of said lead-in conductors are laterally offset relative to the substantially straight end segments thereof, and the associated ends of the sleeve-like coupling members are seated against the offset medial portions of the lead-in conductors and said offset portions thus serve as stop-and-positioning means for the respective coupling members.

4. The incandescent lamp of claim 1 wherein;

said coiled filament is substantially composed of tungsten and the envelope contains a halogen additive which provides and sustains a tungsten-halogen cycle within the envelope, when the lamp is energized, and said incandescent lamp is thus of the halogen-cycle type, and said coupling members and lead-in conductors are composed of a metal that is not chemically attacked by the halogen additive.

5. The incandescent lamp of claim 1 wherein;

said envelope is of elongated configuration and terminated at one end by an hermetic seal, the coiled body portion of the filament is transversely disposed relative to the longitudinal axis of the envelope, the uncoiled legs both extend laterally from the coiled body portion of the filament toward the hermetically sealed end of the envelope, said lead-in conductors are anchored in the hermetically sealed end of the envelope and longitudinally extend therefrom toward said filament, and said coupling members comprise metal tubes.

6. The incandescent lamp of claim 5 wherein;

said lead-in conductors comprise lead wires medial portions whereof are bent and constitute segments that extend transversely relative to the associated end segments of said lead wires, and said coupling tubes are seated against the respective bent medial portions of the lead wires.

7. The incandescent lamp of claim 6 wherein;

said envelope is of tubular configuration and the hermetically sealed end thereof comprises a press seal, the seal-anchored portions of the lead wires and said press seal are substantially located in a plane that extends along the longitudinal axis of the envelope, and the bent medial portions of the lead wires are so oriented that the substantially straight end segments of said head wires and the attached coupling tubes are substantially located in a common plane that is displaced from but is substantially parallel to the longitudinal axis of the envelope.

8. The incandescent lamp of claim 5 wherein;

said envelope contains a second wire filament that has a coiled body portion and laterally-extending substantially straight legs, a second pair of lead-in conductors are anchored in the sealed end of the envelope and have substantially straight end segments that are substantially aligned with and connected to the legs of said second filament by a second pair of coupling tubes, and both pairs of lead-in conductors have bent medial portions that extend transversely in opposite directions and are so arranged that the coiled body portions of said pair of filaments are laterally spaced from one another.

9. The incandescent lamp of claim 5 or 8 wherein;

said coupling tubes are disposed in compressively-clamped relationship with the joined ends of the respective filament legs and lead-in conductors, and the portions of the lead-in conductors that are located between the coupling tubes and the sealed end of the envelope are joined together by a bridge member of electrically non-conductive material.

10. In the manufacture of an electric incandescent lamp having an envelope that contains a coiled filament and a pair of lead-in wires that are anchored in a sealed portion of the envelope, said coiled filament being of the type that is terminated by a pair of laterally-depending uncoiled legs that are disposed in side-by-side spaced relationship, the method of electrically and mechanically coupling the ends of said lead-in wires to the respective filament legs comprising, arranging the ends of said lead-in wires so that their spacing and orientation substantially correspond to that of the legs of the coiled filament, slipping a metal sleeve-like member over each end of said lead-in wires and fastening the overlying parts of the sleeve-like members to the lead-in wires so that the ends of the sleeve-like members protrude beyond the tips of the respective wires, inserting the legs of the coiled filament into the protruding open ends of the respective sleeve-like members until the tips of said legs are seated against the tips of the associated lead-in wires, and then fastening the ends of said sleeve-like members to the parts of the associated filament legs which they enclose.

* * * * *